United States Patent [19]

Moller

[11] 4,087,042

[45] May 2, 1978

[54] PACKING CARTON FOR BREAKABLE ARTICLES

[75] Inventor: Bent Moller, Vaerlose, Denmark

[73] Assignee: Aktieselskabet Brodrene Hartmann, Lyngby, Denmark

[21] Appl. No.: 689,523

[22] Filed: May 24, 1976

Related U.S. Application Data

[63] Continuation of Ser. No. 497,670, Aug. 15, 1974, abandoned.

[30] Foreign Application Priority Data

Aug. 31, 1973 Germany ..... 2344053

[51] Int. Cl.[2] ..... B65D 1/24

[52] U.S. Cl. ..... 229/44 EC; 229/29 M; 229/2.5 EC

[58] Field of Search ..... 229/2.5 EC, 44 EC, 45 EC, 229/29 M; 220/337

[56] References Cited

U.S. PATENT DOCUMENTS

| | | | |
|---|---|---|---|
| 3,469,763 | 9/1969 | Voorhis | 229/2.5 EC |
| 3,471,078 | 10/1969 | Seest et al. | 229/2.5 EC |
| 3,616,487 | 11/1971 | Dearth | 220/337 |
| 3,790,062 | 2/1974 | Boyd | 229/2.5 EC |
| 3,813,027 | 5/1974 | Misdom, Jr. et al. | 229/2.5 EC |
| 3,817,441 | 6/1974 | Jackson | 229/2.5 EC |

*Primary Examiner*—William Price
*Assistant Examiner*—Douglas B. Farrow
*Attorney, Agent, or Firm*—Pennie & Edmonds

[57] ABSTRACT

Packing carton for breakable articles, in particular eggs, consisting of a container member, a lid member hinged on the latter by means of an articular fold or hinge line, and a closing flap hinged on one of these members by means of an articular fold or hinge line which when the lid member is closed over the container member engages in the respective other member, its outside lying opposite the inside of one of the side walls of this member. At least one fastening projection is provided on the outside of the flap, and at least one fastening opening is provided in the relative side wall to accommodate the projection when the carton is closed. On the inside of at least one of the said articular folds at least one projection is provided jutting from the articular fold or hinge line.

8 Claims, 3 Drawing Figures

PACKING CARTON FOR BREAKABLE ARTICLES

This is a continuation, of application Serial No. 497,670, filed Aug. 15, 1974 and now abandoned.

The present invention relates to a packing carton for breakable articles, in particular eggs, consisting of a container member, a lid member hinged on the latter by means of an articular fold or hinge line, and a closing flap hinged on one of these members by means of an articular fold or hinge line which when the lid member is closed over the container member engages in the respective other member, its outside lying opposite the inside of one of the side walls of this member, wherein at least one fastening projection is provided on the outside of the flap, and at least one fastening opening is provided in the relative side wall to accomodate the projection when the carton is closed.

When closing such a carton, problems may arise in practice from the parts hinged together being too strongly inclined towards one another, and in particular from the closing flap being inclined inwards too far so that there cannot be a proper engagement between the fastening projection and fastening opening.

It has already been proposed to solve this problem by providing on the inside both of the closing flap and of the adjacent container or lid member, protruberant supporting surfaces which when the closing flap is tilted inwards come to lie against one another so that further inclination of the closing flap is prevented.

The present invention differs from this proposal in that on the inside of at least one of these articular folds, at least one projection is provided jutting from the articular fold or hinge line. The projection may advantageously be oblong in the direction of the articular fold or hinge line.

When the closing flap is turned inwards, this projection is wedged in between the parts of the carton adjacent to the closing fold, and therefore inhibits further pivoting of the flap.

According to a further development of the idea of the invention, the projection may have a U-shaped cross-section such that the free ends of the U are joined to the articular fold or hinge line.

Advantageously the projection may be of smaller wall thickness at least in its middle section than the parts of the articular fold adjacent to it.

The invention is explained in detail in the following with reference to the drawing.

Figure 1:
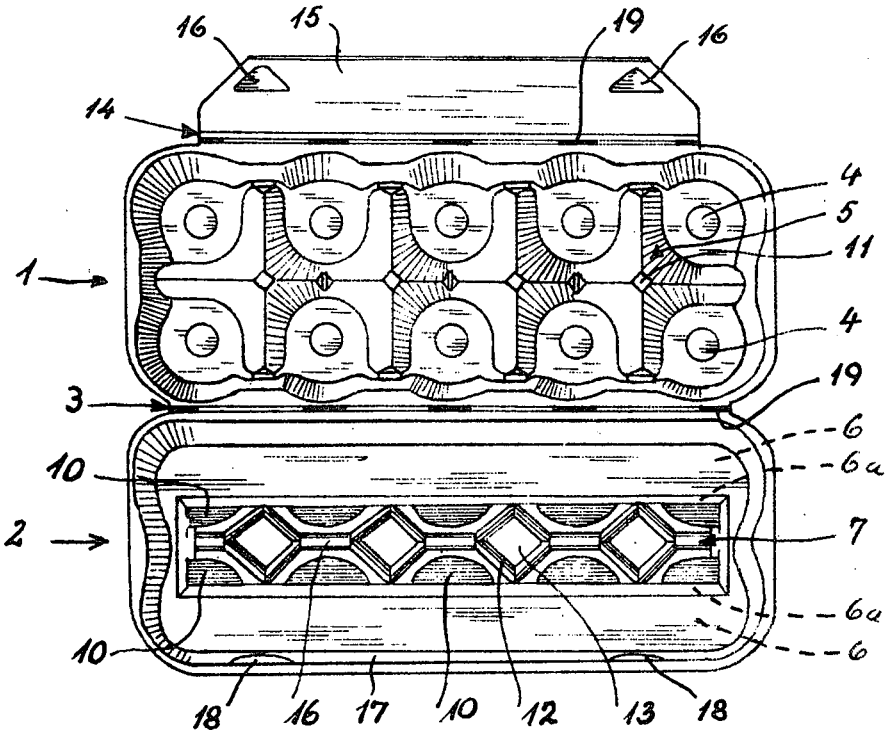
FIG. 1 shows in the opened state the insides of an embodiment of a packing carton formed in accordance with the invention in the form of a specimen package.

The packing carton shown consists of a container member 1 and a lid member 2. The two members are joined together by an articular fold or hinge line 3. The carton is designed for packing eggs.

The container member has two parallel rows of egg pockets 4, wherein five pockets 4 are placed in each row in the example illustrated. Disposed between the pockets placed next to each other in rows are protruberant supporting projections in the form of hollow pins 5 which define the pockets and act as supports for the lid member 2 when it is closed over the container member 1.

The lid member 2 has two parallel, protruberant gable members 6 which extend parallel to the rows of pockets and lie above these rows when the package is closed. Extending between the gable members is a sunken lid section 7 which joins together the lower edges of the facing sides **6*a* of the gable members. 10 indicates a number of inspection holes for the eggs. These holes are formed partly in the sides 6*a* of the gable members, and partly in the lid section 7. The number of holes 10 corresponds to the number of pockets 4 and they are disposed so as to lie opposite the pockets 4 when the package is closed. In the present example there are therefore five holes 10 in each gable member 6**.

The dimensions of the package are such that when the package is closed the upper section of the gable members 6 is higher and the lid section 7 lower than the upper section of the eggs placed in the package, and such that the gable members 6 are narrower than the said part of the eggs.

Consequently a part of the eggs is visible in the holes 10 when the package is closed, and may project a bit through the holes even so far as to come into contact with the edges of them and be held thereby.

The supporting projections 5 have a bearing surface 11 at their upper end.

Between the gable members 6, the lid member 2 is provided with counter-projections 12 with contact surfaces designed to rest on the surfaces 11 indicated by 13. In the example shown, the counter-projections 12 are formed as part of the sunken lid section 7.

When the package is closed the front surfaces of the projections 5 and 12 are adjacent to one another.

A closing flap 15 is hinged on the container member 1 by means of an articular fold or hinge line 14. This flap has two projections 16 on its outside. When the carton is closed the closing flap 15 is introduced into the lid member 2 and lies in it along the front inner wall 17 of the same. Fastening openings 18 corresponding to the two projections 16 are provided in the inner wall, through which the projections 16 project when the package is closed thereby holding the lid member 2 securely over the container member 1.

Figure 2:
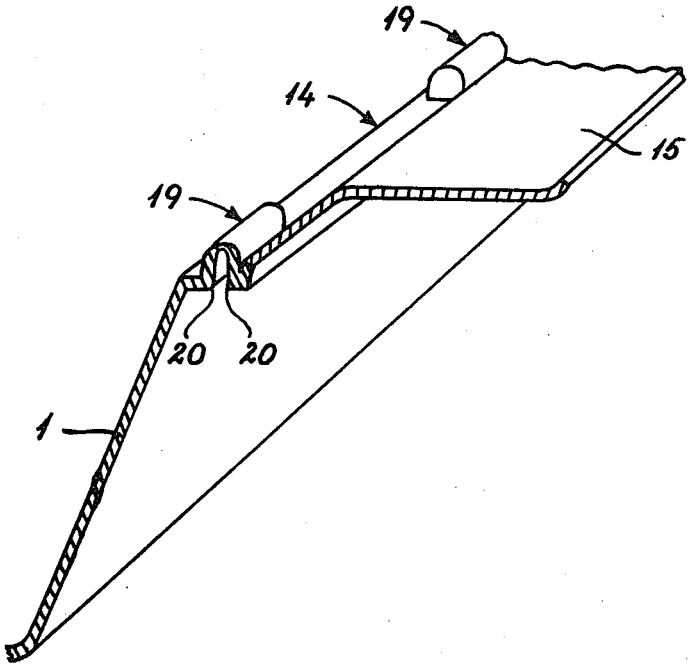
FIG. 2 is a view on a larger scale of a cross-section through an articular fold of the carton in the region of a projection in the fold provided in accordance with the invention.

In accordance with the invention projections 19 which protrude from the articular fold, are provided in the articular folds 3 and 14. FIG. 2 shows such a projection in the articular fold 14 between the container member 1 and the closing flap 15. The projection is oblong in the direction of the articular fold and has a U-shaped cross-section such that the free ends 20 of the U are joined to the articular fold. As a result an interruption in the fold join is formed in the region limited by the free ends of the U. FIG. 1 shows a series of these projections 19 uniformly distributed along the articular folds 3 and 14, wherein in each case a projection is provided at the respective end of the fold. The projections may be of smaller wall thickness at least in their middle section than the adjacent parts of the articular fold, and if desired may even be more or less open.

Figure 3:
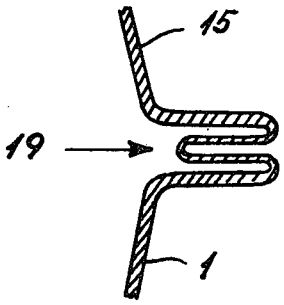
FIG. 3 is a cross-section through an articular fold in the region of a projection in which the fold is folded together.

When pivoting the closing flap over the container member 1, as shown in FIG. 3, the projections 19 provided in the articular fold 14 are wedged in between the adjacent parts, and thus act as a barrier against further pivoting. The same applies to the projections in fold 3.

Naturally, the projections proposed in accordance with the invention can be used with the same or similar advantages to those explained in other packages that the type shown by way of example.

I claim:

1. A packing carton for breakable articles such as eggs comprising a container member, a lid member, and a closing flap; a hinge line securing said lid member to said container member; a hinge line securing said closing flap to one of said members; said hinge line being of a width substantially equal to the thickness of the carton; said flap, when said lid member is in closed position on said container member, engaging the other of said members; the outside surface of said flap in said closed position lying against the inside surface of one side wall of said other member; at least one fastener projection projecting outwardly from the outside surface of said flap; at least one cooperating fastener opening in said side wall of said other member; said fastener projection when said flap is in said closed position, being engaged in said fastener opening to maintain the carton closed, a plurality of hinge projections jutting from the inner surface of at least one of said hinge lines for controlling and guiding the hinging thereof; said carton being free of any other projections cooperating with said hinge projections that jut from the hinge line; and said carton being of molded pulp construction.

2. A packing carton according to claim 1 in which said hinge projection is elongated in the direction of its associated hinge line.

3. A packing carton according to claim 1 in which said hinge projection is U-shaped in cross section with the free ends of the U joined to the hinge line.

4. A packing carton according to claim 1 in which there are a plurality of said hinge projections spaced along the length of the hinge line.

5. A packing carton according to claim 3 in which said hinge projection is of a lesser thickness in the bight of said U than the free ends thereof.

6. A packing carton according to claim 1 in which there is one such hinge projection at each end of said hinge line.

7. A packing carton according to claim 5 in which there are a plurality of said U-shaped hinge projections provided along the length of said hinge line.

8. A packing carton according to claim 1 in which there are a plurality of said hinge projections provided along the length of said hinge line; a plurality of hinge projections along the length of the other of said hinge lines; all of each hinge projections being elongated and U-shaped in cross section with the free ends of the U joined to the respective hinge line and the bight of the U being of lesser thickness than the free ends of the U.

* * * * *